US005717380A

United States Patent [19]

Zehrung

[11] Patent Number: 5,717,380

[45] Date of Patent: Feb. 10, 1998

[54] MONITOR HINGE

[76] Inventor: Raymond E. Zehrung, 3029 Cameron Way, Santa Clara, Calif. 95051

[21] Appl. No.: 709,940

[22] Filed: Sep. 9, 1996

[51] Int. Cl.[6] ..... G08B 13/08

[52] U.S. Cl. ..... 340/545; 340/549; 340/686; 200/61.7

[58] Field of Search ..... 340/545, 549, 340/686, 635, 671; 200/61.7

[56] References Cited

U.S. PATENT DOCUMENTS

| | | | |
|---|---|---|---|
| Re. 30,716 | 8/1981 | Suska | 200/61.7 |
| 2,620,411 | 12/1952 | Liley | 200/61.7 |
| 4,140,357 | 2/1979 | Wolz et al. | 200/61.7 |
| 4,150,265 | 4/1979 | Holden | 200/61.7 |
| 4,168,409 | 9/1979 | McNinch | 200/61.7 |
| 4,185,280 | 1/1980 | Wilhelm | 340/685 |
| 4,284,861 | 8/1981 | Senften | 200/61.7 |
| 4,841,283 | 6/1989 | Bubliewicz | 340/545 |

*Primary Examiner*—Thomas Mullen
*Assistant Examiner*—Anh La
*Attorney, Agent, or Firm*—David R. Gildea

[57] ABSTRACT

A monitor hinge having a rotary switch or potentiometer that is concealed within knuckles of the hinge for providing an indication when a door or a window is open. A monitor cable connects terminals on the rotary switch or potentiometer through the hinge to an external monitoring apparatus. An optional power transfer cable passes power or a signal through the hinge between a wall and a door or a window.

4 Claims, 4 Drawing Sheets

MONITOR HINGE

BACKGROUND OF THE INVENTION

1. Field of the Invention

The invention relates generally to door and window hinges and more particularly to a hinge for monitoring the opening of a door or window.

2. Description of the Prior Art

There are a number of applications for a product for monitoring whether a door or a window is open or closed. Examples of such applications are turning a light on or off, sounding an alarm, detecting a possible entry, and managing the security of an enclosed area. Several approaches have been used for these applications. One approach has been to mount a push-button switch in a wall jamb against which the door or window is hinged. The push-button is depressed by the door or window jamb when the door or window is closed. When the door or window is opened, the push-button is released and the switch either makes or breaks an electrical contact. The making or breaking of the electrical contact is used for lighting the light, sounding the alarm, or otherwise indicating to an external monitoring device when the door or window is open. However, this approach has disadvantages of requiring a separate part for the push-button switch, being easily tampered with because the push-button is exposed, and requiring a custom installation for recessing a cavity in the wall jamb for the housing of the push-button switch.

Workers in the field have eliminated the disadvantage of having a separate part for the switch by integrating the push-button switch onto the wall-mounted leaf of one of the hinges used for mounting the door or window. However, such integrated switching hinges still leave the push-button exposed to tampering and require a custom recessed cavity in the wall jamb for installation of the switch housing.

There is a need for a device for monitoring when a door or window is opened or closed that is not subject to tampering, uses no separate parts, and does not require a cavity to be recessed into a wall jamb for a switch housing.

SUMMARY OF THE INVENTION

It is therefore an object of the present invention to provide a monitor hinge having an integral rotary switch or potentiometer that is concealed within knuckles of the hinge for providing an indication when a door or a window is open or closed.

Briefly, in a preferred embodiment, the monitor hinge includes two hinge leaves having interleaved knuckles sharing a common bore and a rotary switch or potentiometer disposed in the common bore for giving an indication of when the hinge is open or closed. A monitor cable connects terminals on the rotary switch or potentiometer through a longitudinal passageway in one hinge leaf to an external monitoring apparatus. An optional power transfer cable passes power or a signal through the hinge between a wall and a door or a window.

An advantage of the monitor hinge of the present invention is that it requires no separate parts, is concealed, and does not require a cavity in a wall jamb for a switch housing, thereby reducing the cost of installation and being more resistant to tampering.

These and other objects and advantages of the present invention will no doubt become obvious to those of ordinary skill in the art after having read the following detailed description of the preferred embodiments which are illustrated in the various figures.

IN THE DRAWINGS

DETAILED DESCRIPTION OF THE PREFERRED EMBODIMENTS

Figure 1:
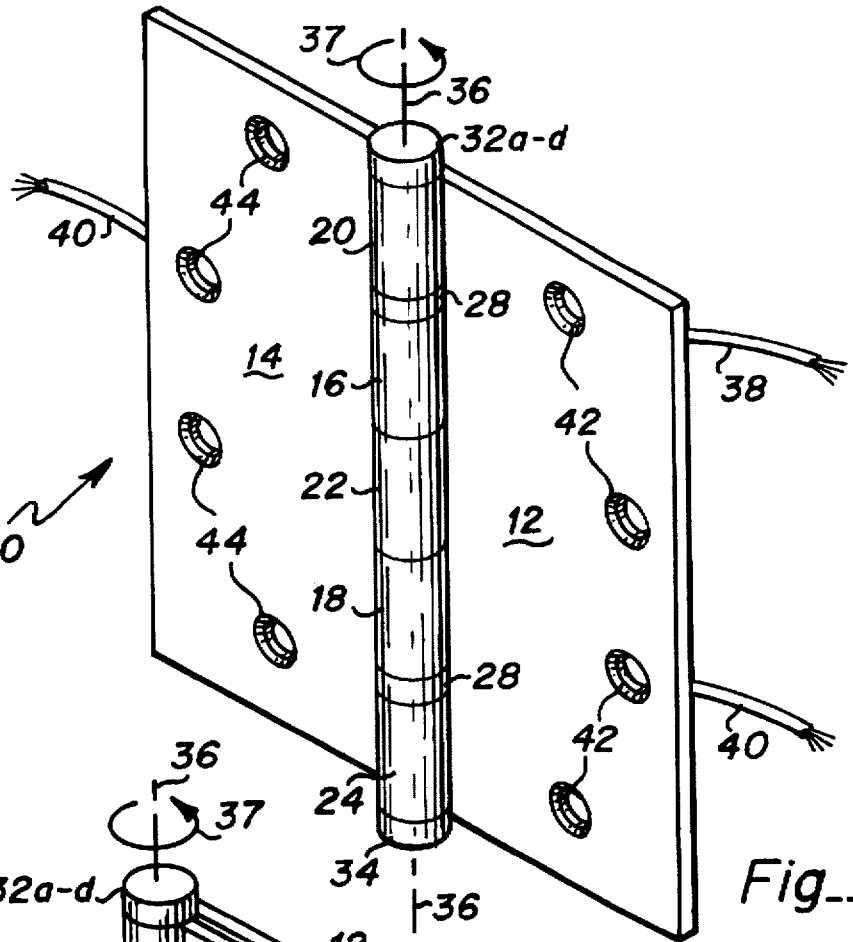
FIG. 1 is a perspective view of the monitor hinge of the present invention in an open position.
Figure 2:
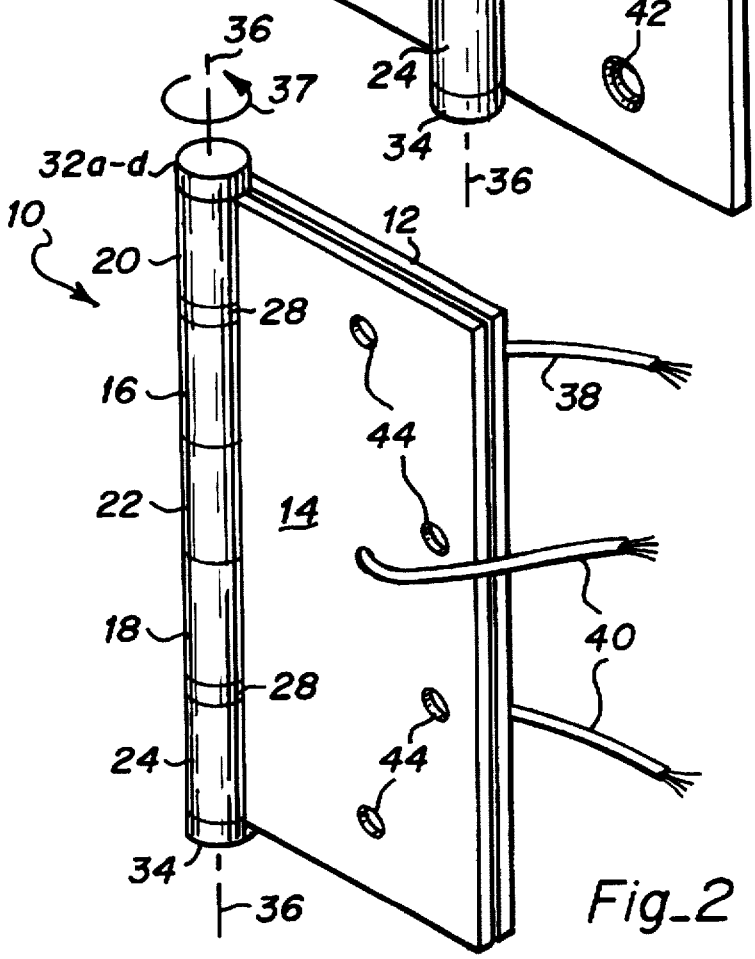
FIG. 2 is a perspective view of the monitor hinge of FIG. 1 in a closed position.

FIG. 1 is a front perspective view of the monitor hinge of the present invention referred to herein by the general reference number 10 illustrated in an open position. The hinge 10 includes a first hinge leaf 12 and a second hinge leaf 14. Knuckles 16 and 18 on the first hinge leaf 12 and knuckles 20, 22, and 24 on the second hinge leaf 14 are interleaved and share a common knuckle bore 26 (FIGS. 3, 4, 7, and 8). Optional ball bearing races 28 attach to the knuckles 16 and 18. The hinge leaves 12 and 14 are rotationally connected by an upper pin 32*a* (shown in FIGS. 1–3 and 5*a–b*), 32*b* (shown in FIGS. 1–3 and 6*a–b*), 32*c* (shown in FIGS. 1–3 and 7), and 32*d* (shown in FIGS. 1–3 and 8) and a lower pin 34. The upper pin 32*a*, 32*b*, 32*c*, or 32*d* and lower pin 34 each have a pin head and an integral shaft disposed within the knuckle bore 26 (FIGS. 3, 4, 7, and 8). The lower pin 34 is staked or otherwise retained in the knuckle bore 26 of the knuckle 24. In operation, the first and second hinge leaves 12 and 14 rotate about a center axis 36 in the rotational direction 37 for the hinge 10 for closing a door or a window. FIG. 2 shows the hinge 10 in the closed position.

A monitor cable 38 passes an open or a closed indication that is detectable by an external monitoring apparatus for indicating when the hinge 10 is opened or closed. An optional transfer cable 40 passes power or a signal through the hinge 10 between a wall and the door or window. Fastening holes 42 enable the first hinge leaf 12 to be screwed into the wall jamb and fastening holes 44 enable the second hinge leaf 14 to be screwed into the door or window jamb.

Figure 3:
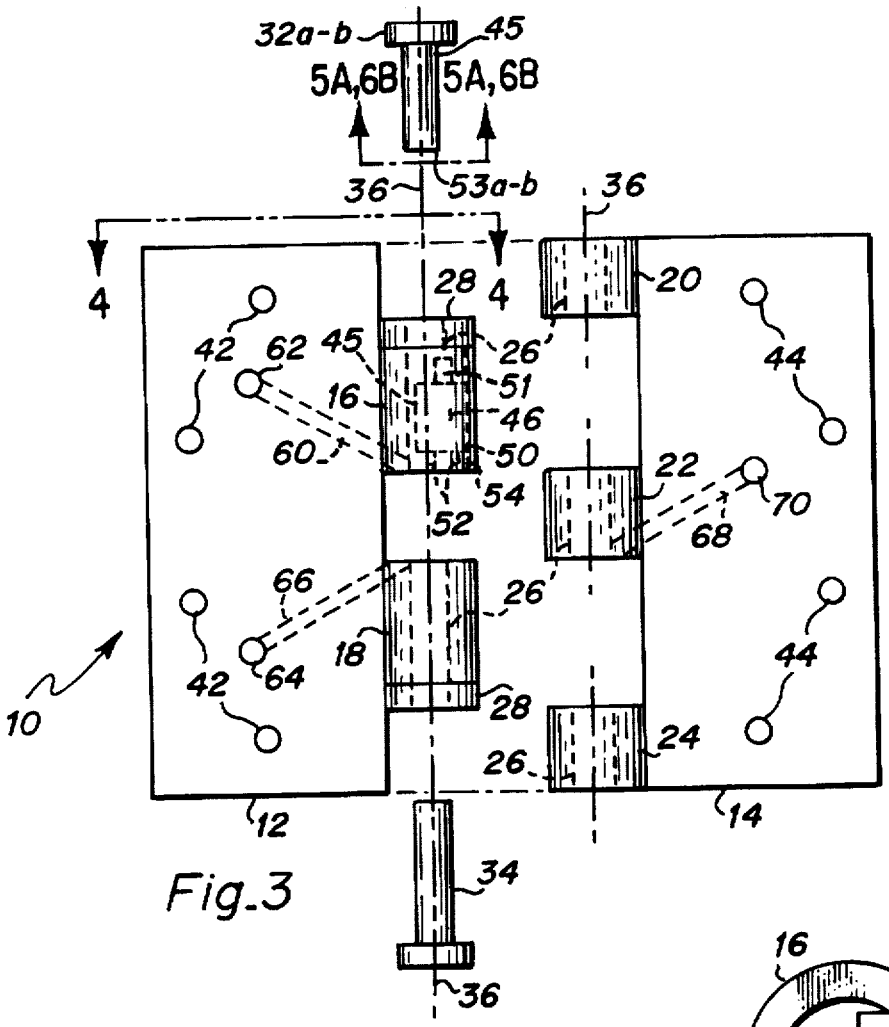
FIG. 3 is an exploded cross-sectional view of a first embodiment of the monitor hinge of FIG. 1.

FIG. 3 is a rear, partially exploded, cross-sectional view of an embodiment of the monitor hinge 10 showing the first and second hinge leaves 12 and 14, respectively, the knuckles 16, 18, 20, 22, 24, the ball races 28, the lower pin 34, the transfer cable 40, and the fastening holes 42 and 44 as described in the detailed description accompanying FIG. 1.

A rotary switch 45, including the upper pin 32*a* or 32*b* and a push-button switch 46, is disposed in the knuckle bore 26 for giving a closed indication when the hinge 10 is in the closed position, shown in FIG. 2. When the first hinge leaf 12 and the second hinge leaf 14 are rotated open relative to each other past an angular actuation threshold, an open indication is given. Typically, the threshold is an angle of about three to six degrees, thereby indicating when the door or window is slightly open or ajar. The push-button switch 46 includes a switch housing 50, a push-type actuator rod 51 mounted parallel and offset from the center axis 36 and slidingly attached through the top of the switch housing 50, and two or more terminals 52 mounted to the switch housing 50. The bottom end of the upper pin 32*a* or 32*b* includes a control surface 53*a* (FIGS. 5A–B) or 53*b* (FIG. 6A–B), respectively, adjacent to the top of the actuator rod 51. When the actuator rod 51 is depressed, the push-button switch 46 is actuated. An example of such push-button switch 46 is commercially available from C & K Components, Inc. of Clayton, N.C. as a part number TP12SH8AQE.

Figure 4:
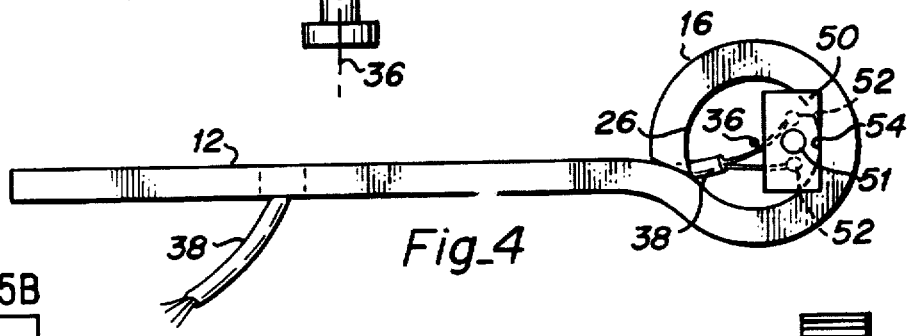
FIG. 4 is a top view of a hinge leaf of the monitor hinge of FIG. 3.

The switch housing 50 is mounted in a slot 54 in the bore 26 of the knuckle 16, thereby fixing the switch housing 50 to the hinge leaf 12. The upper pin 32*a* or 32*b* is retained in the knuckle bore 26 of the knuckle 20, thereby fixing the upper pin 32*a* or 32*b* to the hinge leaf 14. In operation, the actuator rod 51 is depressed by an eccentric recess 56 (FIGS. 5A–B) or protrusion 58 (FIGS. 6A–B) on the control surface 53*a* or 53*b* by rotating the upper pin 32*a* or 32*b*, respectively, with respect to switch housing 50, thereby converting the actuation of the push-button switch 46 to the actuation of the rotary switch 45 for giving the open or closed indication for the hinge 10. To avoid cocking, the upper pin 32*a* should have a tight fit in the knuckle bore 26 of the knuckle 16 (FIGS. 3 and 4). The shaft of the upper pin 32*a* may be knurled to increase its effective diameter. An ohmmeter may be used in the assembly of the hinge 10 to align the pin 32*a* or 32*b* with the hinge leaf 14 such that the control surface 53*a* or 53*b*, respectively, is aligned for the desired angular actuation threshold.

Wires in the monitor cable 38 (FIGS. 1, 2, and 4) are connected to the terminals 52 on the switch housing 50 and routed through a longitudinal passageway 60 and a recess 62 in the first hinge leaf 12 to the wall. The transfer cable 40 is routed through a recess 64 and a longitudinal passageway 66 in the first hinge leaf 12, the knuckle bore 26, a longitudinal passageway 68 and a recess 70 in the second hinge leaf 14. Such transfer cable 40, recesses 64 and 70, and longitudinal passageways 66 and 68 are described in U.S. Pat. No. 5,586,895 which is incorporated herein by reference.

FIG. 4 is a top view of the first hinge leaf 12 looking in the direction of the arrows along the cross section line 4 in the FIG. 3. The switch 50 mounts into the slot 54 in the knuckle bore 26 of the knuckle 16. The actuator rod 51 of the switch housing 50 is offset from the center axis 36. The wires of the monitor cable 38 are connected to the terminals 52 (FIG. 3) and pass through the first hinge leaf 12 for carrying the open/closed indication for the relative rotation of the first hinge leaf 12 and the second hinge leaf 14 (FIGS. 1, 2, and 3).

Figure 5A:
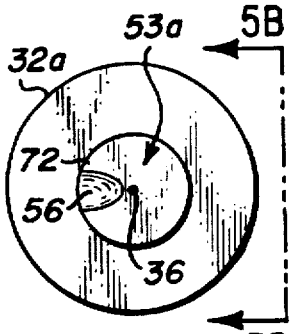
FIGS. 5A and 5B are bottom and side views, respectively, of a pin having a control surface having a recess for the monitor hinge of FIG. 3.
Figure 5B:
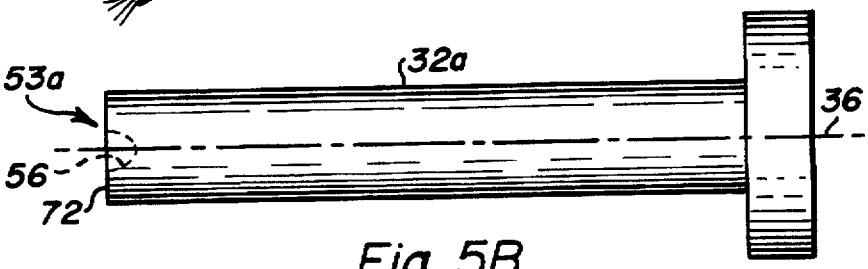

FIG. 5A is a bottom view of the upper pin 32*a* looking in the direction of the arrows along the cross section line 5A in the FIG. 3. FIG. 5B is a side view of the upper pin 32*a* looking in the direction of the arrows along the cross section line 5B in the FIG. 5A. The upper pin 32*a* includes the control surface 53*a* at the bottom end of the upper pin 32*a*. The control surface 53*a* includes a plateau 72 and the recess 56 having beveled sides and extending approximately from the center axis 36 to the edge of the control surface 53*a*. The recess 56 is located so that the actuator rod 51 (FIGS. 3 and 4) is disposed in the recess 56 and is not depressed when the hinge 10 is closed. When the hinge 10 begins to open, the actuator rod 51 (FIGS. 3 and 4) is gradually pushed down by the beveled sides of the recess 56 until the actuator rod 51 (FIGS. 3 and 4) is depressed to or beyond an actuation threshold. When the threshold is reached the rotary switch 45 (FIG. 3) gives the open indication that is passed by the monitor cable 38 (FIGS. 1, 2, and 4) to the external monitoring device.

Figure 6A:
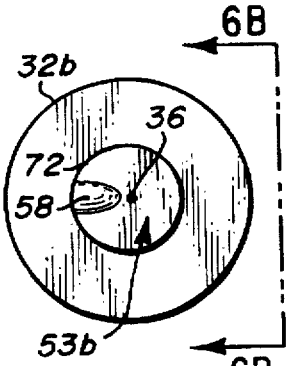
FIGS. 6A and 6B are bottom and side views, respectively, of a pin having a control surface having a protrusion for the monitor hinge of FIG. 3.
Figure 6B:
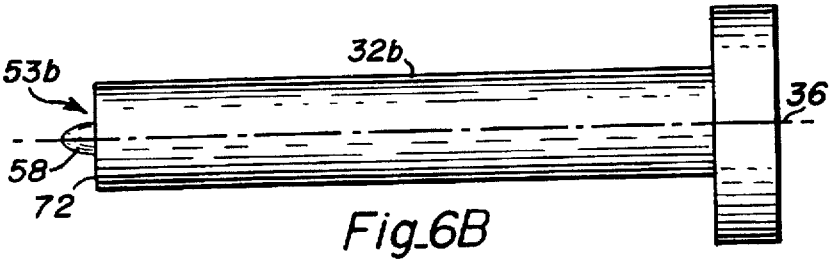

FIG. 6A is a bottom view of the upper pin 32*b* looking in the direction of the arrows along the cross section line 6A in the FIG. 3. FIG. 6B is a side view of the upper pin 32*b* looking in the direction of the arrows along the line cross section line 6B in the FIG. 6A. The upper pin 32*b* includes the control surface 53*b* at the bottom end of the upper pin 32*b*. The control surface 53*b* includes the plateau 72 and the protrusion 58 having beveled sides and extending approximately from the center axis 36 to the edge of the control surface 53*b* so that the actuator rod 51 (FIGS. 3 and 4) is disposed on the protrusion 58 and is depressed when the hinge 10 is closed. When the hinge 10 begins to open, the depression of the actuator rod 51 (FIGS. 3 and 4) is gradually relieved by the beveled sides of the protrusion 76 until the actuation threshold is reached. When the threshold is reached the rotary switch (FIG. 3) gives the open indication that is passed by the monitor cable 38 (FIGS. 1, 2, and 4) to the external monitoring device.

Figure 7:
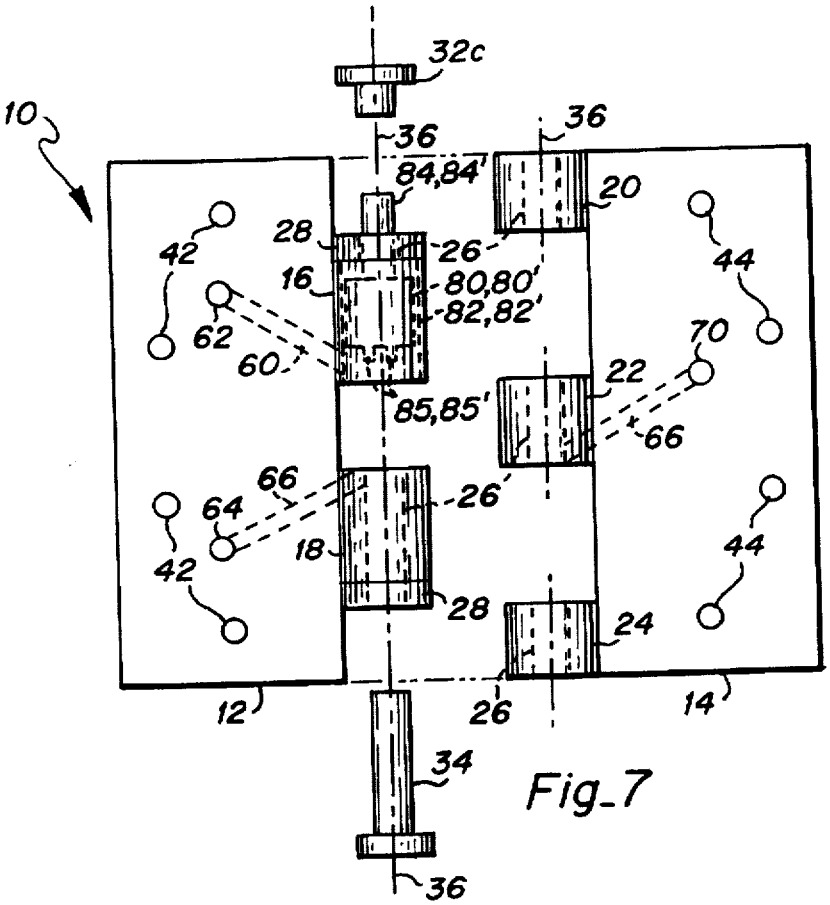
FIG. 7 is an exploded cross-sectional view of a second embodiment the monitor hinge of FIG. 1.

FIG. 7 is a rear, partially exploded, cross-sectional view of an embodiment of the monitor hinge 10 showing the first and second hinge leaves 12 and 14, respectively; the knuckles 16, 18, 20, 22, 24; the ball races 28; the pins 32*c* and 34; the center axis 36; and the fastening holes 42 and 44 as described in the detailed description accompanying FIG. 1. A rotary switch 80 is disposed in the knuckle bore 26. When the hinge 10 is in the closed position shown in the FIG. 2 the rotary switch 80 gives the closed indication. As the first hinge leaf 12 and the second hinge leaf 14 are rotated relative to each other past a threshold, the open indication is given. Typically, the threshold is an angle in the range of about three to six degrees, thereby indicating that the door or window is slightly open or ajar.

The rotary switch 80 includes a switch housing 82, a switch rotor 84 for actuating the switch 80, and terminals 85 for connecting to the wires of the monitor cable 38 (FIGS. 1 and 2). The switch housing 82 is staked, glued, press fit, or otherwise retained in the knuckle bore 26 of the knuckle 16 and prevented from turning relative to the hinge leaf 12. The knuckle bore 26 of the knuckle 16 may be enlarged or shimmed for fitting the switch housing 82. The switch rotor 84 extends into the knuckle bore 26 of the knuckle 20 and is retained from turning relative to the knuckle 20. The bearing 28 through which the switch rotor 84 passes may need to be removed for assembly of the rotary switch 80 into the hinge 10.

The rotary-type switch 80 may be replaced by a potentiometer 80' having a potentiometer housing 82' and a potentiometer rotor 84'. The potentiometer 80' has a variable resistance whose value depends upon the rotational angle of the potentiometer rotor 84' with respect to the potentiometer housing 82'. The potentiometer housing 82' is retained in the knuckle bore 26 of the knuckle 16 and prevented from turning relative to the knuckle 16. The potentiometer rotor 84' extends into the knuckle bore 26 of the knuckle 20 and is retained from turning relative to the knuckle 20. When the hinge 10 is in the closed position shown in the FIG. 2 the potentiometer 80' has a high resistance. As the first hinge leaf 12 and the second hinge leaf 14 are rotated toward the open position relative to each other the resistance decreases.

Alternatively, the potentiometer 80' may have a low resistance when the hinge 10 is in the closed position and increase in resistance as the first hinge leaf 12 and the second hinge leaf 14 are rotated toward the open position relative to each other. Wires in the monitor cable 38 (FIGS. 1 and 2) are connected to terminals 85 or 85' on the rotary switch 80 or rotary potentiometer 80', respectively, and routed through the longitudinal passageway 60 and the recess 62. The optional transfer cable 40 is routed through the recess 64, the longitudinal passageway 66, the knuckle bore 26, the longitudinal passageway 68, and the recess 70.

An ohmmeter may be used in the assembly of the hinge 10 to align the switch rotor 84 or potentiometer rotor 84' in the bore 26 of the knuckle 20 with respect switch housing 82 or potentiometer housing 82', respectively, in the bore 26 of the knuckle 16.

Figure 8:
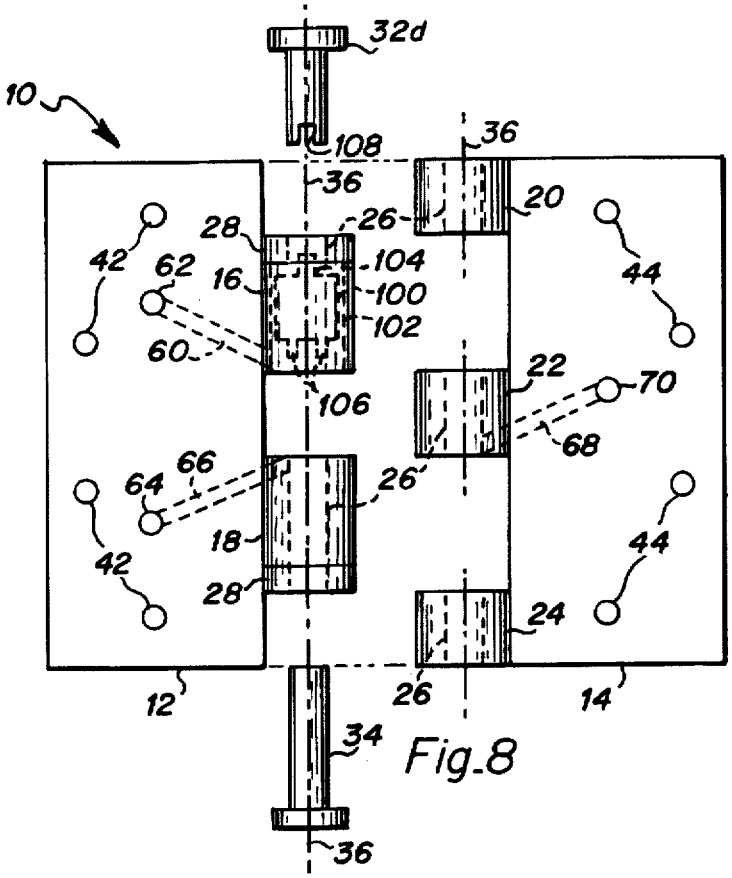
FIG. 8 is an exploded cross-sectional view of a third embodiment of the monitor hinge of FIG. 1.

FIG. 8 is a rear, partially exploded, cross-sectional view of an embodiment of the monitor hinge 10 showing the first and second hinge leaves 12 and 14, respectively; the knuckles 16, 18, 20, 22, 24; the ball races 28; the pins **32*d* and 34; the center axis 36; and the fastening holes 42 and 44 as described in the detailed description accompanying FIG. 1. A rotary-type switch 100 is disposed in the knuckle bore 26. When the hinge 10 is in the closed position shown in the FIG. 2 the switch 100 gives the closed indication. As the first hinge leaf 12 and the second hinge leaf 14** are rotated relative to each other past a threshold, the open indication is given. Typically, the threshold is an angle in the range of about three to six degrees, thereby indicating that the door or window is slightly open or ajar.

The rotary switch 100 includes a switch housing 102, a key 104 for actuating the switch 100, and at least two terminals 106 for connecting to the wires of the monitor cable 38 (FIGS. 1 and 2). A slot 108 in the upper pin **32*d* engages the key 104. The switch housing 102 is staked, glued, press fit, or otherwise retained in the knuckle bore 26 of the knuckle 16 and prevented from turning relative to the hinge leaf 12. The upper pin 32*d* is staked, glued, press fit, or otherwise retained in the knuckle bore 26 of the knuckle 20 and prevented from turning relative to the hinge leaf 14. Wires in the monitor cable 38 (FIGS. 1 and 2) are connected to terminals 106 on the switch 100 and routed through the longitudinal passageway 60 and the recess 62 in the first hinge leaf 12 to the external monitoring apparatus. The optional transfer cable 40 is routed through the optional recess 64 and the optional longitudinal passageway 66 in the first hinge leaf 12, the knuckle bore 26, the optional longitudinal passageway 68 and the optional recess 70 in the second hinge leaf 14**.

Figure 9A:
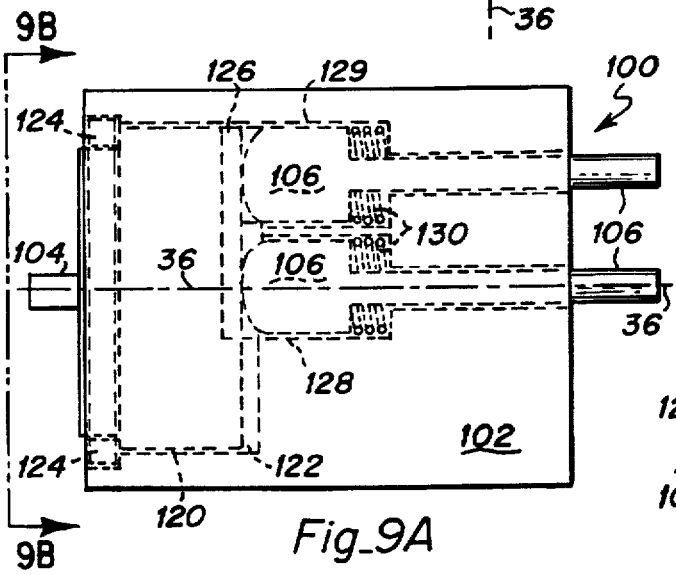
FIGS. 9A and 9B are side and top cross-sectional views, respectively, of a rotary switch for the monitor hinge of FIG. 8.
Figure 9B:
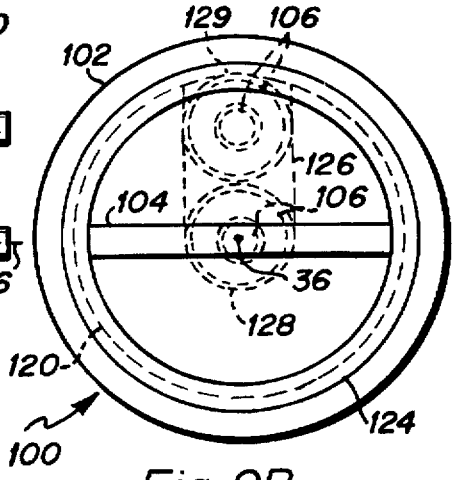

FIGS. 9A and 9B are side and top cross-sectional views, respectively, of the rotary switch 100. A switch rotor 120 that is integral with the key 104 is disposed in a circular, stepped cavity 122 in the top side of the switch housing 102 and retained against the bottom of the cavity 122 by a retaining ring 124. The bottom of the switch rotor 120 includes an electrically conducting wiper 126 extending radially from the center axis 36. First and second circular stepped bores 128 and 129 connect the bottom of the cavity 122 to the bottom of the switch housing 102, the first bore 128 is coaxial with the center axis 36 and the second bore 129 is parallel to the center axis 36 near to the outer perimeter of the cavity 122. The terminals 106 are slidingly disposed in the bores 128 and 129 and biased upwardly by springs 130 from steps in the bores 128 and 129 against the bottom of the cavity 120.

In operation, the slot 108 of the pin **32*d* (FIGS. 1, 2, and 8) turns the key 104 and the switch rotor 120 so that the wiper 126 electrically connects and disconnects the terminals 106. For best results the upper surfaces of the terminals 106 are rounded. The switch 100 gives the closed indication when the hinge 10 is in the closed position shown in the FIG. 2 and gives the open indication when the hinge 10 is in the open position shown in the FIG. 1. The indication changes from closed to open when a three foot wide door has approximately a one inch gap from the wall jamb and has a hysteresis of about one quarter inch. An ohmmeter may be used in the assembly of the hinge 10 to align the pin 36*d* (FIGS. 1, 2, and 8) in the knuckle bore 26 of the knuckle 20 of the hinge leaf 14 such that the wiper 126 connects the terminals 106 when the hinge 10 is in the closed position shown in the FIG. 2. In a preferred embodiment, the switch housing 102, the key 104, and the switch rotor 120 are made of Ultem, the terminals 106 and the wiper 126 are made of copper flashed with nickel; and Loctite 415 or 493 is used to glue the switch housing 102 to the bore 26 of the knuckle 16 (FIGS. 1, 2, and 8), the pin 32*d* (FIG. 8) to bore 26 of the knuckle 20 (FIGS. 1, 2, and 8), and the wiper 126 to the switch rotor 120. The bottom surface of the switch rotor 120 and the wiper 126** may be sanded with emery paper to remove excess glue.

In preferred embodiments, the rotary switch 45 (FIG. 3), 80 (FIG. 7), or 100 (FIG. 8) 80 is "normally open" so that when the hinge 10 is closed the switch 45, 80, or 100 presents an open circuit on the monitor cable 38 (FIGS. 1, 2, and 8). Alternatively, the rotary switch 45, 80, or 100 may be constructed as "normally closed" so that when the hinge 10 is closed the switch 45, 80, or 100 presents a closed circuit on the monitor cable 38. Or, the rotary switch 45, 80, or 100 may be a "double pole" so that the switch 45, 80, or 100 presents a first circuit being open and a second circuit being closed when the hinge 10 is closed and the first circuit being closed and the second circuit being open when the hinge 10 is rotated to or beyond the angular actuation threshold. Note that the words "open" and "closed" in the context of an electrical switch refer to electrical contacts being connected or not connected, respectively. An open circuit means that electrical current is not allowed to pass while a closed circuit means that electrical current is allowed to pass.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A monitor hinge, comprising:

a first hinge leaf;

a second hinge leaf rotationally connected to the first hinge leaf;

a knuckle bore common to the first and second hinge leaves and concentric with a center axis about which the first and the second hinge leaf rotate;

an electrically conductive first terminal disposed in the knuckle bore approximately coaxial with said center axis, the first terminal having first top end;

an electrically conductive second terminal disposed in the knuckle bore offset and approximately parallel with said center axis and engaged to the first hinge leaf for rotating about said center axis as the first hinge leaf rotates with respect to the second hinge leaf, the second terminal having a second top end; and an electrically conductive wiper disposed in the knuckle bore and engaged to the second hinge leaf, the wiper extending outwardly from said center axis and aligned for connecting said first top end to said second top end when the first hinge leaf and the second hinge leaf have a predetermined relative angle of rotation with respect to one another, whereby said connection gives an indication of a relative angle of rotation between the first and second hinge leaves.

2. The hinge of claim 1, further including:

a monitor longitudinal passageway in the first hinge leaf; and a monitor cable routed through the monitor longitudinal passageway for connecting the first and second terminals to an external device.

3. The hinge of claim 1, further including:

a first transfer longitudinal passageway and a second transfer longitudinal passageway in the first and second hinge leaf, respectively; and a transfer cable routed through the first and second transfer longitudinal passageways for transferring power across the hinge.

4. The hinge of claim 1, further including:

a switch housing having a first bore for disposing the first terminal and a second bore for disposing the second terminal, the switch housing disposed in the knuckle bore and fixed to the first hinge leaf;

a switch rotor having a bottom end for disposing the wiper, the switch rotor disposed in the knuckle bore and fixed to the second hinge leaf;

a first spring for biasing the first terminal upwardly from the switch housing for pressing said first top end against said bottom end of the switch rotor; and a second spring for biasing the second terminal upwardly from the switch housing for pressing said second top end against said bottom end of the switch rotor, whereby said indication is caused by a relative rotation of the switch rotor and the switch housing.

* * * * *